United States Patent [19]

Castel

[11] Patent Number: 4,810,109

[45] Date of Patent: Mar. 7, 1989

[54] SUPPLE BAG MADE BY FLAT ASSEMBLY OF A SYSTEM OF FILMS INTENDED TO CONSTITUTE, BY EXTENSION, A STABLE RECIPIENT, AND PROCESS FOR OBTAINING SAME

[76] Inventor: Jean Castel, 10, rue Louise Lesieur, 94700 Maisons-Alfort, France

[21] Appl. No.: 87,422

[22] Filed: Aug. 19, 1987

[30] Foreign Application Priority Data

Aug. 21, 1986 [FR] France ..... 86 11926

[51] Int. Cl.[4] ..... B65D 30/16

[52] U.S. Cl. ..... 383/105; 383/104; 383/120; 383/121; 383/907

[58] Field of Search ..... 383/104, 120, 121, 907, 383/105; 229/69, 185.42

[56] References Cited

U.S. PATENT DOCUMENTS

| | | | |
|---|---|---|---|
| 3,437,258 | 4/1969 | Kugler | 383/104 |
| 3,438,567 | 4/1969 | Bell, Jr. | 383/104 |
| 3,559,874 | 2/1971 | Titchenal | 229/69 |
| 3,640,381 | 2/1972 | Kanada et al. | 383/104 |
| 4,353,497 | 10/1982 | Bustin | 383/120 |
| 4,361,235 | 11/1982 | Gautier | 383/104 |
| 4,394,955 | 7/1983 | Raines et al. | 383/104 |

FOREIGN PATENT DOCUMENTS

| | | | |
|---|---|---|---|
| 2150649 | 4/1972 | Fed. Rep. of Germany | 383/105 |
| 1115256 | 4/1956 | France | 383/120 |
| 1327875 | 4/1963 | France . | |
| 1349272 | 12/1963 | France . | |
| 82575 | 1/1964 | France . | |
| 83259 | 11/1964 | France . | |
| 84495 | 11/1965 | France . | |
| 1592464 | 6/1970 | France . | |
| 2192951 | 2/1974 | France . | |
| 421811 | 4/1967 | Switzerland | 383/105 |
| 1069268 | 5/1967 | United Kingdom . | |

OTHER PUBLICATIONS

Search Report–FR 8611926 (consisting of 3 pgs.) 4/1987.

*Primary Examiner*—Willis Little

*Attorney, Agent, or Firm*—Ladas & Parry

[57] ABSTRACT

This invention relates to a supple bag made by flat assembly of a system of films, intended to constitute, by extension, a stable recipient, and to a process for obtaining said bag. According to the invention, this bag is obtained by assembling the films along lateral and bottom contours and along a base line previously traced geometrically by developing on the films the lateral surface of the recipient which was previously determined in its form and characteristics, in order that the recipient rests, after being filled and closed, in stable manner on its support base, not presenting any point of fold along its lateral edges. The invention finds particular application in the food industry, for packing beverages.

9 Claims, 4 Drawing Sheets

SUPPLE BAG MADE BY FLAT ASSEMBLY OF A SYSTEM OF FILMS INTENDED TO CONSTITUTE, BY EXTENSION, A STABLE RECIPIENT, AND PROCESS FOR OBTAINING SAME

FIELD OF THE INVENTION

The present invention relates to a supple bag made by flat assembly of a system of films, bag intended to constitute, by extension, a stable recipient, and to a process for obtaining said bag.

The invention finds particular application in the production of closed recipients, intended in particular to contain liquid products, and which are stable in upright position, whatever their size whether they are empty or full, open or closed, and whether they are isolated or connected to other recipients of the same shape or of different shape.

BACKGROUND OF THE INVENTION

Packings made from supple film material offer numerous advantages. They are light, take up little space before and after use, are robust and inexpensive.

When they are intended to pack liquid products, such as beverages, these recipients must present a good stability in upright position, in the same way as rigid bottles or containers.

The known processes for obtaining such packings are described in particular in French Patents Nos. 1 327 875, 1 349 272 and their Certificates of Addition, in French Patent Application No. 2 192 951 and in British Patent No. 1 069 268. These processes employ the flat assembly of a system of films constituted by at least one supple sheet and comprising an inner pleat in the form of a flattened V with substantially parallel and rectilinear edges, intended to constitute, after extension, the bottom of the recipient. This pleat is intercalated between two portions of sheet with substantially parallel and rectilinear edges, preferably superposed on said edges of the inner pleat, and intended for making the lateral wall of the recipient. Assembly is effected along lateral and bottom contours, of which the outline is always the result of an arbitrary choice and does not obey any particular rule.

On the other hand, and in common with all these prior art documents, in order to ensure stability of the full recipient, in upright position, the support base is always constituted by substantially rectilinear and parallel edges of the inner pleat and/or the portions of sheet intended to constitute the lateral wall. One is thus limited to very simple forms, the lateral assemblings generally being effected along parallel straight lines substantially perpendicular to the rectilinear edges of the films intended to form the support base, and running from one edge of the films to be assembled to the other.

Furthermore, the full recipient is closed by bringing together and assembling the free edges, opposite the part forming base, of the system of films, and forming opening for filling the recipient.

However, this concept of embodiment presents a certain number of drawbacks which affect the appearance and especially the mechanical strength of the recipients, and singularly complicate the industrial processes of filling and closing the latter.

In fact, by construction, the recipients obtained by the processes of the prior art present, after having been filled and closed, folds in the lateral assemblings. Such folds are detrimental to the aesthetics of the recipient and constitute zones of weakness where the recipient tends to bend, and even to burst if it is under too much strain.

Attempts have already been made to overcome this drawback by choosing more rigid materials. However, this solution is not satisfactory, on the one hand by reason of the difficulties of assembling and of the high cost of this type of material, and, on the other hand, because the use of rigid materials is detrimental to the stability of the recipient on its base since the recipient then rests only on the lower points of its lateral assemblings.

The bags allowing such recipients to be made are obtained from at least one reel of supple film, in the form of webs, said bags being connected to one another successively in two's.

However, during the industrial filling and closing processes, these bags are separated into individual units, before being filled. The problem is then raised of locating the filling nozzle relatively to the opening of the bag, and this problem is all the more difficult to solve as the opening is small.

It is an object of the present invention to solve the new technical problem by providing a novel supple bag made by the flat assembly of a system of films, making it possible to obtain recipients intended in particular to contain liquid products and which are stable in upright position, whatever their size, whether they are open or closed and which, in the latter case, may be easily filled and closed, by bringing together and assembling the lips of the filling orifice, whether they are in isolated form or connected to other recipients of the same form or of different form, without lateral folds.

SUMMARY OF THE INVENTION

The invention satisfactorily solves for the first time this new technical problem by proposing a bag intended to constitute, by extension, a supple recipient, of the type obtained by flat assembly of a system of films constituted by at least one sheet and comprising at least one inner pleat in the form of a flattened V with substantially parallel and rectilinear edges, intended to constitute, after extension, the bottom of the recipient, and intercalated between two portions of sheet with substantially parallel and rectilinear edges, preferably superposed and merged with said edges of the inner pleat, and intended to form the lateral wall of said recipient, said assembling being made along lateral and bottom contours, characterized in that said bag is obtained by assembling, in addition, the films along a base line, not merged with said parallel and rectilinear edges of the films, defining the contour of the support base of the recipient, said lateral and bottom contours and said base line having been traced geometrically by developing on the films to be assembled the lateral surface of the recipient which was previously determined in its form and characteristics, in order that said recipient rests, after being filled and closed, in stable manner on its support base, not presenting any point of fold along its lateral edges.

The invention is based on a novel concept which follows from the following two observations:—the bags are assembled from films or sheets with parallel, rectilinear and merged edges, but there is no reason for the base line defining the support base on which the extended recipient must rest, necessarily to merge materially with said parallel and rectilinear edges of the sheets to be assembled;—there necessarily exists one bag configuration, and only one, which corresponds to a recipient which was previously desired in its form, capacity and dimensions, and which therefore does not present any break or fold along its lateral edges, in upright position after filling and closure.

In radically opposite manner from the prior art techniques, the form and volume of the recipient which it is desired to obtain are previously determined, according to the invention, the volume thus determined is represented flat and its lateral surface is developed on the plane of the films to be assembled, employing to that end the conventional techniques of descriptive geometry.

According to a particular feature of the bag according to the invention, the length separating the point of encounter of the lateral edge and of the opening edge, and the point of encounter of the lateral edge and of the base is the same, after filling, whether the bag is open or closed. It is precisely this characteristic which enables the problems of folds or breaks along the lateral edges to be solved.

In heretofore manufactured bags, this length cannot be constant, since the base line is always rectilinear and parallel to the merged edges of the system of films during industrial closure of such bags, by bringing together the upper lips (portions of sheets opposite the base); it is indispensable at the present time to draw these lips transversely in order to assemble them. This operation is eliminated according to the invention, since one starts from the volume of the closed recipient.

In addition, according to the invention, there is no limit of capacity of the bags, other than the limit imposed by the strength of the material used at the level of that part included between the bottom line and the base line of the recipient. In this way, according to an advantageous embodiment, the portions of films located at the level of the part included between the bottom line and the base line are assembled, for example by gluing, after possibly having been reinforced, particularly by means of at least one pre-cutout portion of film disposed between said portions of film to be assembled. The portions of films located between the base line and the rectilinear, parallel and merged edges are not assembled and may be cut out, preferably before filling, or not cut out.

According to a second aspect, the present invention also relates to a process for obtaining a bag, intended to constitute, by extension, a supple recipient capable of being filled and closed, of the type comprising the flat assembly of a system of films constituted by at least one sheet and comprising an inner pleat in the form of a flattened V with substantially parallel and rectilinear edges, intended to constitute, after extension, the bottom of said recipient, and intercalated between two portions of sheet with substantially parallel and rectilinear edges, preferably superposed and merged with said edges of the inner pleat, and intended to form the lateral wall of said recipient, said assembly being made along lateral and bottom contours, characterized in that it comprises, in addition, the assembly of the films along a base line, not merged with said parallel and rectilinear edges of the films, defining the contour of the support base of the recipient, said lateral and bottom contours and said base line having been traced geometrically by developing on the plane of the films to be assembled the lateral surface of the recipient which was previously determined in its form, in order that said recipient rests, after being filled and closed, in stable manner on its support base, not presenting any point of fold along its lateral edges.

BRIEF DESCRIPTION OF THE DRAWINGS

The invention will be more readily understood on reading the following description with reference to the accompanying drawings, in which:

FIG. 6 is a diagram illustrating the outline, on a flat system of films, of the lines of assembly and bottom lines of bags according to the invention.

DETAILED DESCRIPTION OF THE DRAWINGS

Figure 1:
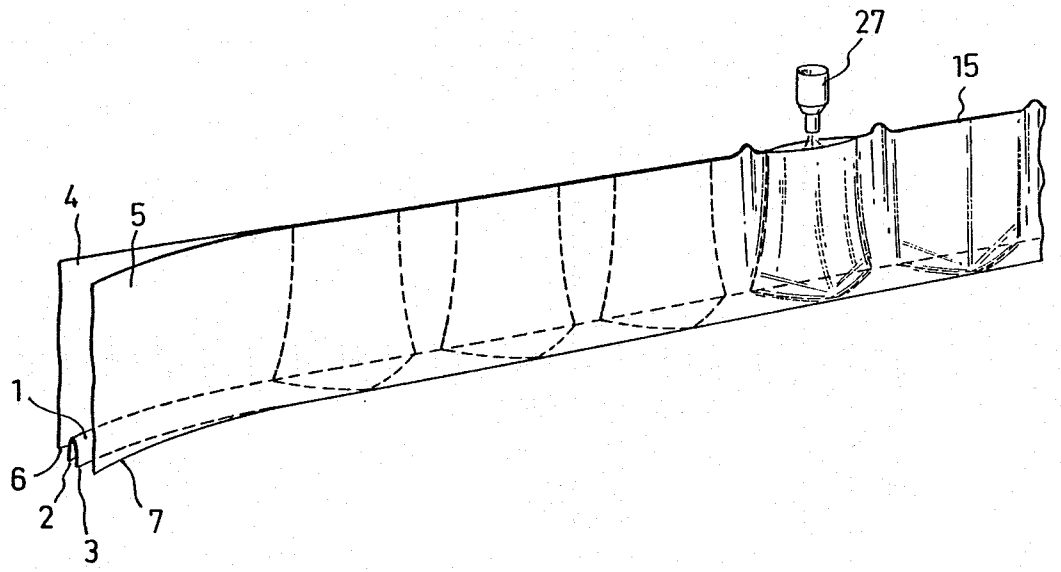
FIG. 1 is a diagram illustrating the process for continuously manufacturing bags according to the invention, as well as for filling and closure.
Figure 2:
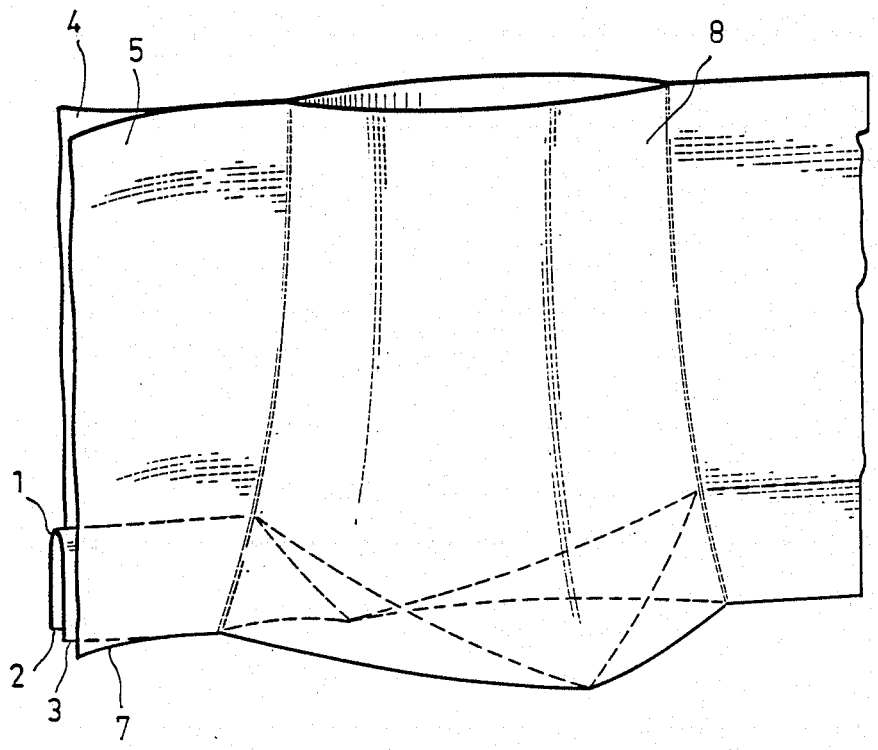
FIG. 2 is a view in perspective of a recipient in the course of being filled, made from a bag according to the invention.

Referring now to the drawings, and firstly to FIG. 1, the bags according to the invention are made from a system of superposed films, comprising at least one inner pleat 1 in the form of a flattened V with substantially parallel and rectilinear edges 2, 3, intended to constitute, after extension, the bottom of the recipient, and intercalated between two portions of sheets 4, 5 with substantially parallel and rectilinear edges 6, 7, preferably merged with the edges 2, 3 of the inner pleat.

This system of films may be constituted, as in the prior art, by means of one single sheet folded three times and presenting a transverse section in the form of a W, in the simplest case, or by means of two plane sheets surrounding a folded sheet, as in the example shown.

The positioning of the inner pleat 1, relatively to the portions of sheets 4, 5, will be determined precisely, as will be explained hereinafter.

It is also possible to produce a "stepped" recipient provided with a plurality of vertically spaced bottoms, by inserting between the two portions of sheets 4, 5, a plurality of inner pleats.

In the preferred embodiment, the bags are produced continuously, by advancing the films to be assembled. These films may for example come from reels on which they are wound.

On these films, assembly lines are traced in accordance with the following general principle:

The recipient which it is desired to obtain is firstly defined, in its form and dimensional and possibly mechanical characteristics;

this recipient is cut through a vertical reference plane passing through a line of the surface of its base cutting the perimeter thereof into two demi-perimeters of equal length;

the limits of the evolute of the lateral surfaces of the two demi-volumes located on either side of said reference plane are traced on the films to be assembled, on either side of their plane;

the bottom assembly lines are traced as being the images of the intersection of the bottom of the recipient with its lateral walls.

Referring now to FIGS. 2 to 6, the process for obtaining a bag for making a recipient with rectangular base, with a useful capacity of 5 liters, closed along a line parallel to the diagonal of the base rectangle, will be described by way of non-limiting example.

The edges of the volume which join the ends of the filling-closure line 15 to those of the corresponding diagonal of the rectangle of the base surface are parallel straight lines perpendicular to the base plane and to the line of closure. On the system of films to be assembled (FIG. 6), there is located a horizontal reference line some millimetres above the superposed, rectilinear, parallel edges of the system of films.

In the example shown, the recipient 8 presents a plane of symmetry, and the construction calls upon only the representation of the demi-volume of the recipient. However, as will be readily understood, the invention also makes it possible to produce "pseudo-symmetrical" recipients, i.e. resulting from the assembly of two demi-volumes of different forms. In that case, it suffices to trace on each face of the system of films, corresponding assembly lines.

The graphic location of the bottom is firstly determined.

To that end, the two demi-bases AMB and ANB are pivoted about their points M and N most remote from the straight line AB, with the result that the straight lines of the base plane containing these points are parallel to AB to take them into a plane parallel to the vertical reference plane and so that they are oriented towards the filling line 15. Section AMB is thus seen along line MY in FIG. 4 and section ANB along line NY.

A plane passing through Y and X cuts the lateral edges 11 and 12 at E and F.

The surface of the bottom is represented by the ruled surface generated by the line MN moving parallel to itself and constantly abutting on the peripheries of the two folded down sections.

The assembly lines are then traced on that face of the films turned towards the operator.

The location of the inner pleat 1 is firstly determined. To that end, a line 13 is traced some millimetres from the lower edge 7 of the film 5, parallel thereto. A perpendicular 14 to this line 13 is traced. These lines intersect at $M_1$ which is associated with point M of the recipient to be reproduced.

Figure 4:
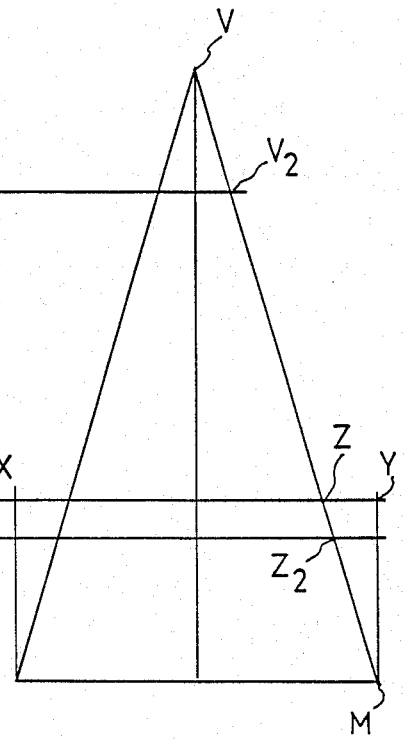

On line 14 is plotted a length $M_1Z_1$ equal to length MZ in FIG. 4. The edge 16 of the inner pleat 1 then merges with a tracing line, parallel to the lower edges 7 of the film 5, and passing through $Z_1$. If it is desired to avoid losses when cutting out, the width of the pleat 1 is chosen to be exactly equal to length $M_1Z_1$, increased by some millimetres.

The assembly lines of the bottom are plotted in accordance with the conventional methods of descriptive geometry for the representation flat of the intersections of volume.

The recipient is cut through several horizontal planes of section.

Figure 3:
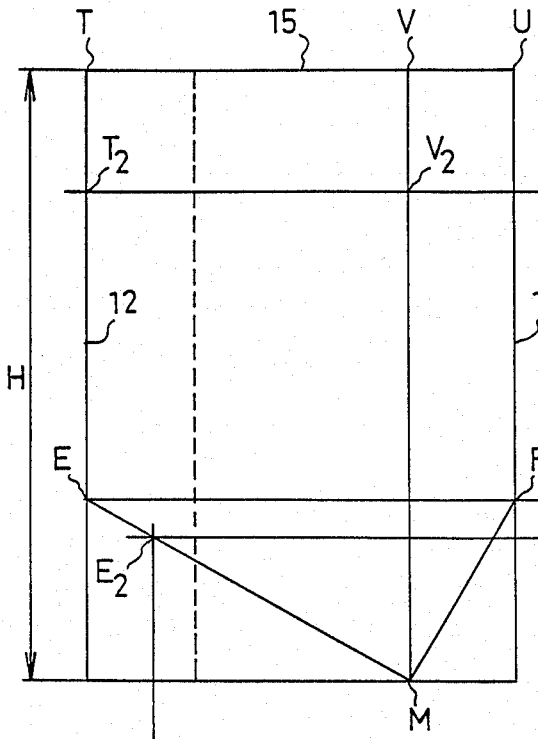
FIGS. 3, 4 and 5 are, respectively, front, side and top views of the recipient of FIG. 2 after closure.
Figure 5:
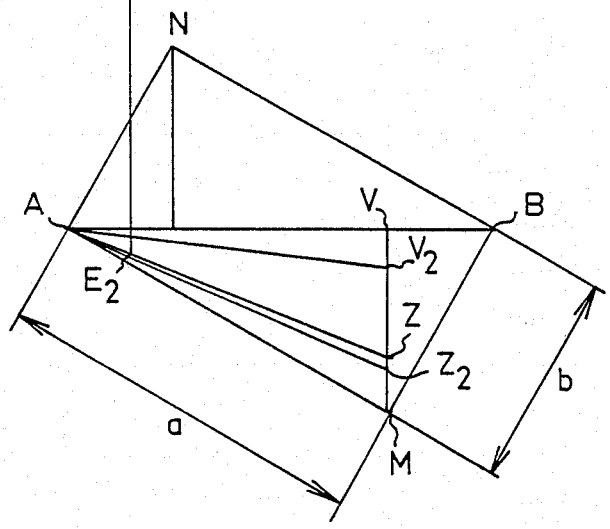
Figure 5:
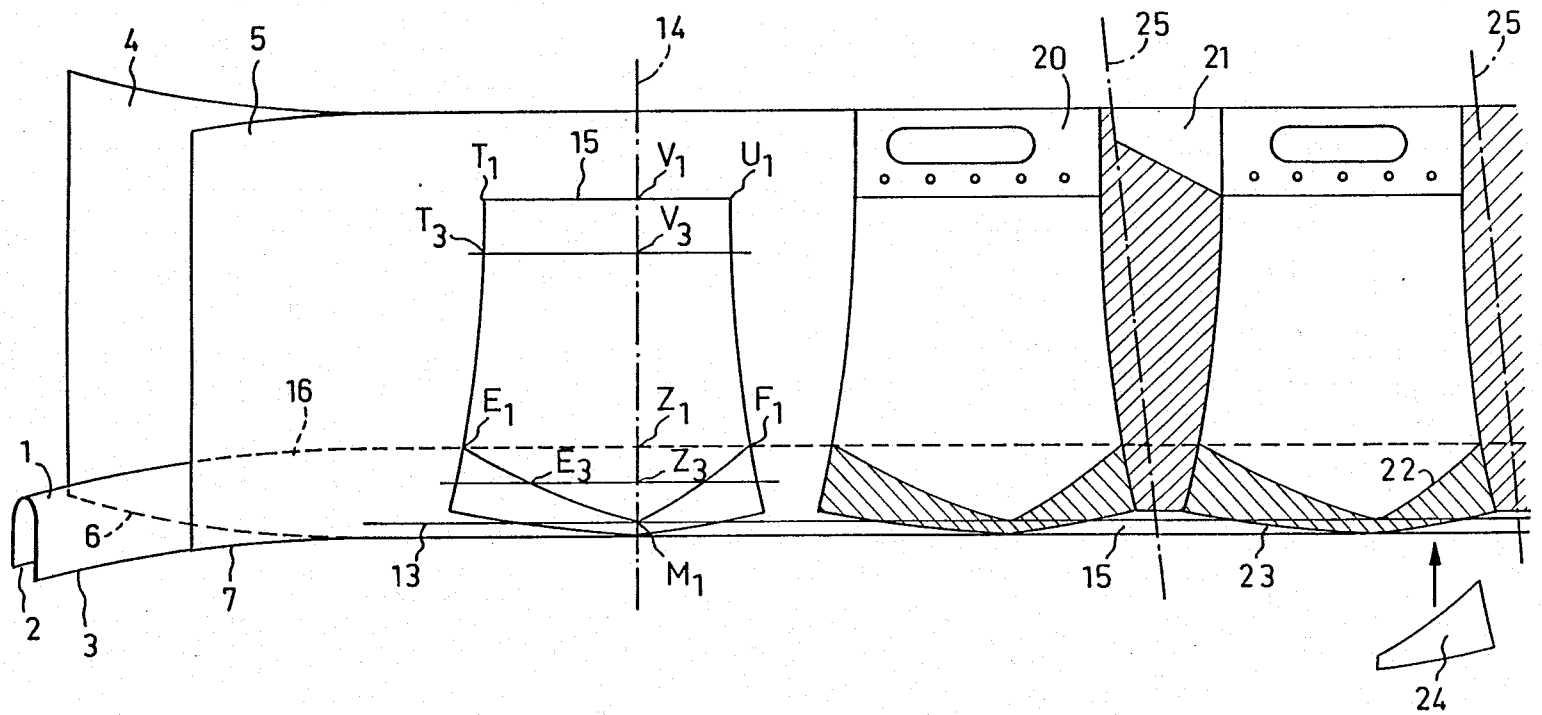

In FIGS. 3, 4 and 5, the plane passing through EFZ is chosen as first plane of section.

Point Z located on VM in FIG. 4 is at a distance ZY from M on the perpendicular of M to AB which represents the edge VM seen from above in FIG. 5.

Point E, in FIG. 5, merges with A and lies at a distance ZA from Z. Point $E_1$ may then be determined in the outline of FIG. 6, by transferring $Z_1E_1=ZA$ on the top line 16 of the inner pleat 1.

A section is made through a second horizontal plane between Y and M, this determining point $Z_2$ on VM of FIG. 4, point $E_2$ on EM in FIG. 4, then point $E_2$ on EM in FIG. 3, and finally point $Z_2$ in FIG. 5.

In this Figure, point $E_2$ is also located on line $Z_2A$.

In FIG. 6, a line is then traced, parallel to the pleat of the inner film 1, passing through a point $Z_3$ located at a distance $Z_1Z_3=Z\ Z_2$. Point $E_3$ is located on this line at a distance $Z_3E_3=Z_2E_2$.

The procedure is the same for other points, which, on joining them, gives the desired profile.

The operation is recommenced for the part of the profile joining F to M.

The outline of the assembly lines is then repeated for the opposite face of the films to be assembled. Due to the symmetry of the recipient, it is in the present case a simple symmetrical transfer.

The lateral assemblings are then traced in the following manner:

In FIG. 6, from $M_1$, a distance $M_1V_1=MV$ is plotted on line 14.

Through $V_1$, a line is traced parallel to the lower edges of the film and the distances $V_1T_1=VT$ and $V_1U_1=VU$ are plotted on either side of $V_1$.

As previously, the recipient shown in FIGS. 3, 4 and 5 is cut through a plane parallel to the base surface, this determining $T_2$ and $V_2$. In FIG. 5, $T_2$ is at a distance $T_2V_2=AV_2$. In FIG. 6, $V_3$ is plotted at a distance $V_1V_3=VV_2$ of FIG. 5.

From $V_3$, an arc of circle of radius $V_3T_3=V_2A$ is plotted.

The procedure is the same for other points: the desired profile being the line starting from $T_1$ which is tangential to all the arcs of circle.

The procedure is the same for the profile starting from $V_1$.

The outline of the base line is obtained by employing a similar method.

The outlines of the profiles in FIG. 6 show portions of films which are unused but which may have an accessory use.

In this way, the portions of films located above the filling-closure line 15 may be cut out to form a handle 20.

A pouring spout 21 may also be formed by leaving a free space towards the top of the recipient.

Between the bottom assembly lines 22 and the base line 23, reinforcing elements may advantageously be slipped between the films 4 and 5 and the adjacent face of the inner pleat 1, which are made for example in the form of cut-outs 24 of more rigid materials. These cut-outs 24, which will preferably follow the shape of the peripheries of their housing very exactly, will ensure good stability of the recipient when it is filled with liquid.

The portions of films located between the base line 23 and the lower edge 2, 3, 6, 7 of the system of films, which are not assembled, may be eliminated by cut-out. However, if it is desired to avoid discarded material, they need not be eliminated and these non-assembled portions will be crushed when the full recipient rests on its base.

Finally, if it is desired to separate the recipient after they have been filled and closed, a cut-out 25 may be provided between the lateral assemblings of two consecutive bags, along any line running from one edge of the films to the other.

The bags according to the invention may be made of any supple material, for example sheets of plastic or waterproof fabrics.

Assembly is effected by sealing along the assembly lines, and by sealing or gluing in the other portions to be assembled, sealing being effected by means of heating jaws for example, or any other means (stitching) depending on the nature of the material.

Of course, in practice, the assembly means will be specifically designed as a function of the outline and the lines of assembly, of closure and of cut-out which will previously have been determined.

As shown in FIG. 1, the bags formed as has just been described arrive at the filling station where they are filled by means of a nozzle 27, then closed along the line of closure 15, for example by means of a heating jaw (not shown).

In accordance with the invention, the filled recipients may be closed without having been previously separated into unitary recipients. The films advancing continuously, the opening of the bags always comes precisely opposite the filling nozzle 27, without any offset occurring during the process. The filling operation is therefore determined by the same marking as all the prior operations, particularly the bag forming operations. On the contrary, in the prior art, the bags are previously separated into individual units before being filled, and it is necessary, for each bag, to locate the filling opening and precisely to position the nozzle relatively to this opening. Such positioning is all the more difficult to effect as the opening of the bag is small. The invention makes it possible to solve this technical problem for the first time.

The advantages of the present invention over the prior art are therefore very numerous.

Firstly, the present invention enables recipients of any forms, dimensions and capacities to be obtained.

The design of these bags offers a simplification of the industrial process of filling and closure, since, contrary to the prior art, it is no longer necessary to draw the lips of the opening edge of the bags transversely in order to assemble them after filling.

In addition, the present invention allows for the first time the production of multiple bags which may be filled and closed without being detached into unitary recipients, in order to make for example groups of sachets filled with complementary products such as formulations to be mixed immediately before use, or for the presentation of different products, but belonging to the same range.

In addition, there is no problem of locating the relative position of the filling nozzle relatively to the opening for filling the bags according to the invention, since it is not necessary to separate them before filling. In this way, in a continuous process for manufacturing recipients, there cannot be any offset between the opening for filling the bags and the filling nozzle.

Finally, the process according to the present invention is compatible with the machines for assembling conventional bags. The outlines may in addition be made by computer assisted design.

It will also be noted that the present invention makes it possible to produce recipients provided with several bases but with only one filling opening. Recipients may also be produced which present characters or animals.

What is claimed is:

1. A bag intended to constitute, by extension, a supple recipient, of the type obtained by flat assembly of a system of films constituted by at least one sheet and comprising at least one inner pleat in the form of a flattened V with substantially parallel and rectilinear edges, intended to constitute, after extension, the bottom of the recipient, and intercalated between two portions of sheet with substantially parallel and rectilinear edges, preferably superposed and merged with said edges of the inner pleat, and intended to form the lateral wall of said recipient, said assembly being made along lateral and bottom contours, wherein said bag is obtained by assembling, in addition, the films along a base line, not merged with said parallel and rectilinear edges of the films, defining the contour of the support base of the recipient, said lateral and bottom contours and said base line having been traced geometrically by developing on the films to be assembled the lateral surface of the recipient which was previously determined in its three-dimensional form and characteristics, in order that said recipient rests, after being filled and closed, in stable manner on its support base, not presenting any point of fold along its lateral edges.

2. The bag of claim 1, wherein the length separating a point of encounter of the lateral edge and of the opening edge, and the point of encounter of the lateral edge and the base is the same, after filling, as the bag, whether open or closed.

3. The bag of claim 1, wherein the portions of films located at the level of the part included between a bottom line and the base line are assembled, for example by gluing, after possibly having been reinforced, particularly by means of at least one complementary pre-cut-out portion of film disposed between said portions of films to be assembled.

4. The bag of claim 1, wherein the bag is formed by a system of films comprising a plurality of inner pleats and the body constitutes by extension a "stepped" recipient provided with one base and with a plurality of superposed bottoms.

5. A process for obtaining a bag, intended to constitute, by extension, a supple recipient capable of being filled and closed, of the type comprising the flat assembly of a system of films constituted by at least one sheet and comprising an inner pleat in the form of a flattened V with substantially parallel and rectilinear edges, intended to constitute, after extension, the bottom of said recipient, and intercalated between two portions of sheet with substantially parallel and rectilinear edges, preferably superposed and merged with said edges of the inner pleat, and intended to form the lateral wall of said recipient, said assembly being made along lateral and bottom contours, said process comprising the additional step of assembling the films along a base line, not merged with said parallel and rectilinear edges of the films, defining the contour of the support base of the recipient, said lateral and bottom contours and said base line having been traced geometrically by developing on the plane of the films to be assembled the lateral surface of the recipient which was previously determined in its three-dimensional form, in order that said recipient rests, after being filled and closed, in stable manner on its support base, not presenting any point of fold along its lateral edges.

6. The process of claim 5, wherein it further consists in assembling, for example by gluing, the portions of films located at the level of that part included between a bottom line and the base line.

7. The process of claim 6, wherein the portions of films located at the level of that part included between the bottom line and the base line are assembled after having been reinforced for example by means of at least one pre-cutout portion of films, disposed between said portions of films to be assembled.

8. The process of claim 6, wherein the portions of films located between the base line and the rectilinear, parallel and merged edges are cut out, preferably before filling.

9. The process of claim 6, wherein the assembly lines are traced in the following manner:

the recipient which it is desired to obtain is cut through a vertical reference plane passing through a line of the surface of its base cutting the perimeter thereof into two demi-perimeters of equal length;

the limits of the evolute of the lateral surfaces of the two demi-volumes located on either side of said reference plane are traced on the films to be assembled, on either side of their plane;

the bottom assembly lines are traced as being the images of the intersection of the bottom of the recipient with its lateral walls.

* * * * *